US008511000B2

(12) United States Patent
Rees

(10) Patent No.: US 8,511,000 B2
(45) Date of Patent: Aug. 20, 2013

(54) INLINE ROTATING RAIN GUTTER

(76) Inventor: Samuel Rees, Morgantown, PA (US)

( * ) Notice: Subject to any disclaimer, the term of this patent is extended or adjusted under 35 U.S.C. 154(b) by 0 days.

(21) Appl. No.: 13/531,797

(22) Filed: Jun. 25, 2012

(65) Prior Publication Data

US 2013/0111824 A1 May 9, 2013

Related U.S. Application Data

(60) Provisional application No. 61/555,809, filed on Nov. 4, 2011.

(51) Int. Cl.
*E04D 13/00* (2006.01)

(52) U.S. Cl.
USPC ..... 52/12; 248/48.1

(58) Field of Classification Search
USPC ..... 52/11, 12, 13, 14, 15, 16; 248/48.1, 248/48.2; 405/119
See application file for complete search history.

(56) References Cited

U.S. PATENT DOCUMENTS 510,515 A * 12/1893 McKenney ..... 52/16
538,108 A * 4/1895 Freeze ..... 52/11
2,523,435 A * 9/1950 Jones ..... 52/16
3,630,473 A * 12/1971 Landis ..... 248/48.2
3,638,369 A * 2/1972 Albrecht ..... 52/16
4,061,151 A * 12/1977 Ward ..... 134/33
4,072,285 A * 2/1978 Greenwood ..... 248/48.2
4,116,008 A * 9/1978 Ward ..... 405/119
4,117,635 A * 10/1978 Nelson ..... 52/11
4,199,121 A * 4/1980 Le Febvre ..... 248/48.2
4,241,547 A * 12/1980 Bove' ..... 52/11
4,309,792 A * 1/1982 Faye ..... 16/389
4,311,292 A * 1/1982 Deason ..... 248/48.2
4,411,108 A * 10/1983 Kerester ..... 52/11
4,413,449 A * 11/1983 Faye ..... 52/16
4,602,460 A * 7/1986 Langenbach ..... 52/1
4,669,232 A * 6/1987 Wyatt ..... 52/11
4,696,131 A * 9/1987 Schreffler ..... 52/11
4,709,516 A * 12/1987 Gleaves ..... 52/11
4,745,657 A * 5/1988 Faye ..... 16/226
4,813,190 A * 3/1989 Wittig ..... 52/11
4,837,987 A * 6/1989 Fender ..... 52/11
5,184,435 A * 2/1993 Sherman ..... 52/12
5,274,965 A * 1/1994 Jackson ..... 52/11
5,357,719 A * 10/1994 Lewis ..... 52/11
5,406,756 A * 4/1995 Bemis et al. ..... 52/16
5,437,138 A * 8/1995 Tuohey et al. ..... 52/741.1
5,548,931 A * 8/1996 Bryant ..... 52/11
5,649,681 A * 7/1997 Faye ..... 248/48.1
5,791,091 A * 8/1998 Barbera ..... 52/12
5,896,706 A * 4/1999 Pike ..... 52/11

(Continued)

*Primary Examiner* — William Gilbert
*Assistant Examiner* — James Ference
(74) *Attorney, Agent, or Firm* — Daniel Boudwin

(57) ABSTRACT

A rain gutter system is provided that permits the gutter to be inverted, including a section of rain gutter that is supported on either side by a rotating assembly that rotates the gutter inline to a downward position. The rotating assembly includes a gearbox that is connected to the gutters, and utilizes a gear mechanism that enables automatic rotation of the gutters. When rotated, the gutters allow loose debris contained therein, such as pine needles and leaves, to fall to the ground without requiring a user to climb to the roof to manually clean an upright gutter. If debris is left behind in the gutter, a hose or power sprayer may be used to clear the gutter of any debris contained therein. Once cleaned, the user may return the gutter to its original position.

7 Claims, 3 Drawing Sheets

(56) References Cited

U.S. PATENT DOCUMENTS

| | | | | |
|---|---|---|---|---|
| 6,233,876 | B1 * | 5/2001 | Obidniak | 52/16 |
| 6,240,679 | B1 * | 6/2001 | Smalara | 52/16 |
| 6,397,526 | B1 * | 6/2002 | Saul et al. | 52/16 |
| 7,152,376 | B2 * | 12/2006 | Wyatt | 52/11 |
| 7,174,676 | B1 * | 2/2007 | Armstrong | 52/11 |
| 7,469,504 | B2 * | 12/2008 | Nocella | 52/12 |
| 7,568,640 | B2 * | 8/2009 | Rademacher | 241/21 |
| 2003/0033756 | A1 * | 2/2003 | Adams et al. | 52/11 |
| 2009/0249703 | A1 * | 10/2009 | Desotell et al. | 52/12 |

* cited by examiner

INLINE ROTATING RAIN GUTTER

CROSS REFERENCE TO RELATED APPLICATION

This application claims the benefit of U.S. Provisional Application No. 61/555,809 filed on Nov. 4, 2011, entitled "Roll Away Rain Gutters." The patent application identified above is incorporated here by reference in its entirety to provide continuity of disclosure.

BACKGROUND OF THE INVENTION

1. Field of the Invention

The present invention relates to rain gutters. More specifically, the present invention pertains to an inline rotating rain gutter.

A rain gutter, which is also known as an eavestrough, or eaves channel guttering, comprises a narrow, elongated channel that is often trough shaped, and forms a component of a roof system. A rain gutter is designed to collect and divert rainwater that would otherwise fall off the edge of a roof. Its purpose is to protect the foundation of a building by channeling water away from its base, which prevents water from pooling and weakening the building's foundation. Additionally, rain gutters can help reduce erosion, prevent leaks in basements and crawlspaces, reduce the effect of water on painted surfaces, and further provide a means of collecting rainwater for other uses.

Conventional rain gutters include a pair of sidewalls, a bottom, and an open top, and are used for channeling water towards a downspout. The open top, however, allows rain gutters to collect debris such as pine needles and fallen leaves. Over time, the buildup of leaves and other debris within the gutters can lead to problems with the flow of rainwater therethrough. If the gutters are allowed to clog and water is prevented from being channeled away from the building, several types of problems can develop. For example, water can overflow down the side of the building and into the foundation, leading to cracks in the walls, and leaks. This is particularly problematic in locations were the ground constantly freezes and thaws, which can lead to severe foundation problems. In addition to foundation problems, clogged rain gutters can lead to the growth of mold within the gutters, which can be harmful to the residents of the building that the gutters are installed thereon. Water can also flow over the sides of the gutters and down the building walls, which can cause wood siding to bow or become covered with mold. Finally, excess water that is not properly channeled away can damage sidewalks, driveways, and interior floors.

To prevent such problems from occurring, regular cleaning of rain gutters is essential. In some locations, particularly those surrounded by trees, gutters should be cleaned three to four times a year. At a minimum, rain gutters should be cleaned annually. This normally takes place at the end of autumn, when the leaves have fallen off of most trees. Homeowners typically wait until the fall because any leaves left in the system may prevent water and snow from properly draining during the winter and spring, where the added weight from the snow may cause the gutter to break away from the house and fall to the ground. In addition to snow, conventional gutters that are clogged can accumulate ice during the winter in the form of icicles, which may eventually fall and injure a person below. To prevent such problems, the present invention provides a means for quickly and easily clean rain gutters, thereby preventing leaves, debris, snow and ice from accumulating therein.

2. Description of the Prior Art

Presently, a common way to clean rain gutters is with a ladder. A user will place a ladder near the rain gutter, climb to the top, and scoop out the loose debris with a narrow garden trowel. The user then has to blast out the remaining debris with a high pressure water nozzle attached to the end of a hose. Finally, the drainpipes must be cleared of any debris that has accumulated therein. This process takes a considerable amount of time, and requires a person to balance on a ladder while using both hands to clean. This is a particularly difficult task when it involves cleaning gutters on the second or third story of a building, where the user is a considerable distance from the ground. An extension ladder must be used, which can be a difficult task for the average person.

Several devices have been disclosed in the prior art that attempt to simplify the process of cleaning rain gutters by utilizing a means of rotating the gutter for cleaning. Many of these devices utilize a mounting bracket with a hinge and a clip. The hinge allows the gutters to be rotated in a circular arc. Faye, U.S. Pat. No. 4,413,449 discloses a rain gutter wherein the gutters may be mechanically inverted to permit any debris therein to fall out. The system utilizes a series of hinged mounting brackets that are horizontally spaced along the length of the gutters. One bracket includes an electric motor positioned below the bracket, a drive mechanism attached to the spindle of the motor, and a pivotable upper harness member attached to the mounting bracket. This device, however, utilizes a bracket with a hinge, and an arm that attaches to the motor. The arm acts as a lever, allowing the gutter to pivot in a circular arc about the hinge, which causes the section of the rain gutters closest to the building to pivot up and over the attachment point of the hinge. This motion can cause a twisting of the rain gutter sections that are furthest from the motor attachment point, which is particularly problematic during the times of the year when the gutters are filled with ice and snow. The added weight of the ice and snow can cause the gutters to deform and become damaged. The design of the present invention, however, permits the entire rain gutter to rotate inline, thereby preventing twisting or deformation.

Other inventions in the prior art disclose a rotating gutter that requires the use of an extended handle with an attachment on the end thereof for detachment of a bracket that holds the gutters in a working position. Wyatt, U.S. Pat. No. 4,669,232 discloses a rain gutter support that enables pivoting of the rain gutters with the application of force by a hand held tool at ground level. This device utilizes a tab that requires an extended handle to release, which can be difficult to maneuver into position from the ground. Additionally, if the tab is not properly secured once the gutters have be rotated for cleaning, the weight of the rain, snow, or ice may cause the gutters to inadvertently release from its locked position, possibly causing damage thereto. The present invention, however, utilizes a system that ensures the gutters return to a locked position when cleaning is completed. When the motor is not in use, the gutters are locked in position, and are unable to rotate.

In addition to the '449 patent, Faye. U.S. Pat. No. 4,309,792 discloses a hinged bracket assembly that enables the gutters to be inverted in order to facilitate the cleaning and servicing thereof. Similarly, Faye, U.S. Pat. No. 4,745,657 discloses a hinged support bracket for a drain trough that includes a harness member which rests above a bracket member. Both harness and bracket members are joined by a hinge mechanism at their forward extremities. The '792 and the '657 patents both utilize a hinged support bracket with an attachment point at the front of the rain gutter, which permits the gutter to be forwardly rotated in a circular arc, thereby causing the inversion of the gutters. These devices are held in position with a clip that rotates in a circular arc, and does not include a motorized pivoting means. Additionally, these prior art devices require the use of an extended handle with an attachment on the end thereof for detachment of the bracket that holds the gutters in a working position. This requires reaching overhead with the extended handle, and positioning the handle in order to release the bracket. The present invention, however, does not require a clip to maintain the gutters in a working position, and prevents the need for an extended handle by utilizing a motor in order to rotate the gutters.

Le Febvre, U.S. Pat. No. 4,199,121 discloses a support system that enables a rain gutter to be inverted with a bracket attachable to a building. The gutter can pivot about the front end of the link to an inverted position by use of a support arm that extends outwardly from the building and attaches underneath the gutter. This system, however, attaches at the front end of the rain gutters, and causes the gutter to rotate counterclockwise, with the section of the gutters closest to the building pivoting down and away from the building. The present invention, however, allows for an inline rotation of the gutters, and does not require the use of a hinge for rotation.

Wittig, U.S. Pat. No. 4,813,190 discloses a rain gutter mounting bracket which is L-shaped, and has a vertical mounting leg and a horizontal projecting arm united to the mounting leg and extending in a spaced relationship underneath the overhang of the roof. A lock pin is employed for locking the L-shaped bracket in position in order to hold the gutter in either an operable or inoperable position. This device, however, requires attachment under the overhang of the building, and requires drilling mounting to the face of the building, where there may be siding. The present invention attaches to the fascia of the building, in the location where a conventional rain gutter would normally be attached, and does not require drilling mounting to the face of the building.

The devices disclosed in the prior art involve rotating a rain gutter in order to remove the debris contained therein. The means by which the devices in the prior art achieve this is with a hinge that allows the gutters to pivot in a circular arc about the hinge. This makes the gutters susceptible to damage when being rotated with a large amount of weight therein, such as when the gutters are filled with ice and snow. The added weight can cause the gutters to twist and deform. The present invention overcomes the limitations inherent in the devices disclosed in the prior art with a design that enables the entire gutter to rotate inline, thereby preventing the need for a hinge or pivot. This allows for rotation of the gutter with an even amount of pressure across the entire length thereof, regardless of the amount of weight contained therein.

In light of the prior art and the disclosed elements of the present invention, it is submitted that the present invention substantially diverges in design elements from the prior art. Consequently it is clear that the present invention is not described by the prior art and that a need exists for an improved rotating rain gutter. In this regard, the instant invention substantially fulfills these needs.

SUMMARY OF THE INVENTION

In view of the foregoing disadvantages inherent in the known types of rain gutters now present in the prior art, the present invention provides a new rain gutter wherein the same can be utilized for providing convenience for the user when cleaning debris that has accumulated in the gutter opening.

It is therefore an object of the present invention to provide a new and improved rain gutter device that has all of the advantages of the prior art and none of the disadvantages.

It is another object of the present invention is to provide a rain gutter that can be rotated for cleaning. Once facing downward, a user can clean the remaining debris with a hose or sprayer.

Another object of the present invention is to provide a rain gutter that utilizes a motor for rotation, thereby preventing the use of a latter or extension pole for cleaning.

Yet another object of the present invention is to provide a rain gutter with a drive means for rotating the gutter, such as a gear mechanism that enables automatic rotation of the gutter, thereby allowing the gutter to pivot to a downward position away from a building.

Another object of the present invention is to provide a rain gutter that rotates the entire gutter inline, thereby preventing the need for a hinge or pivot.

A final object of the present invention is to provide a rain gutter that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
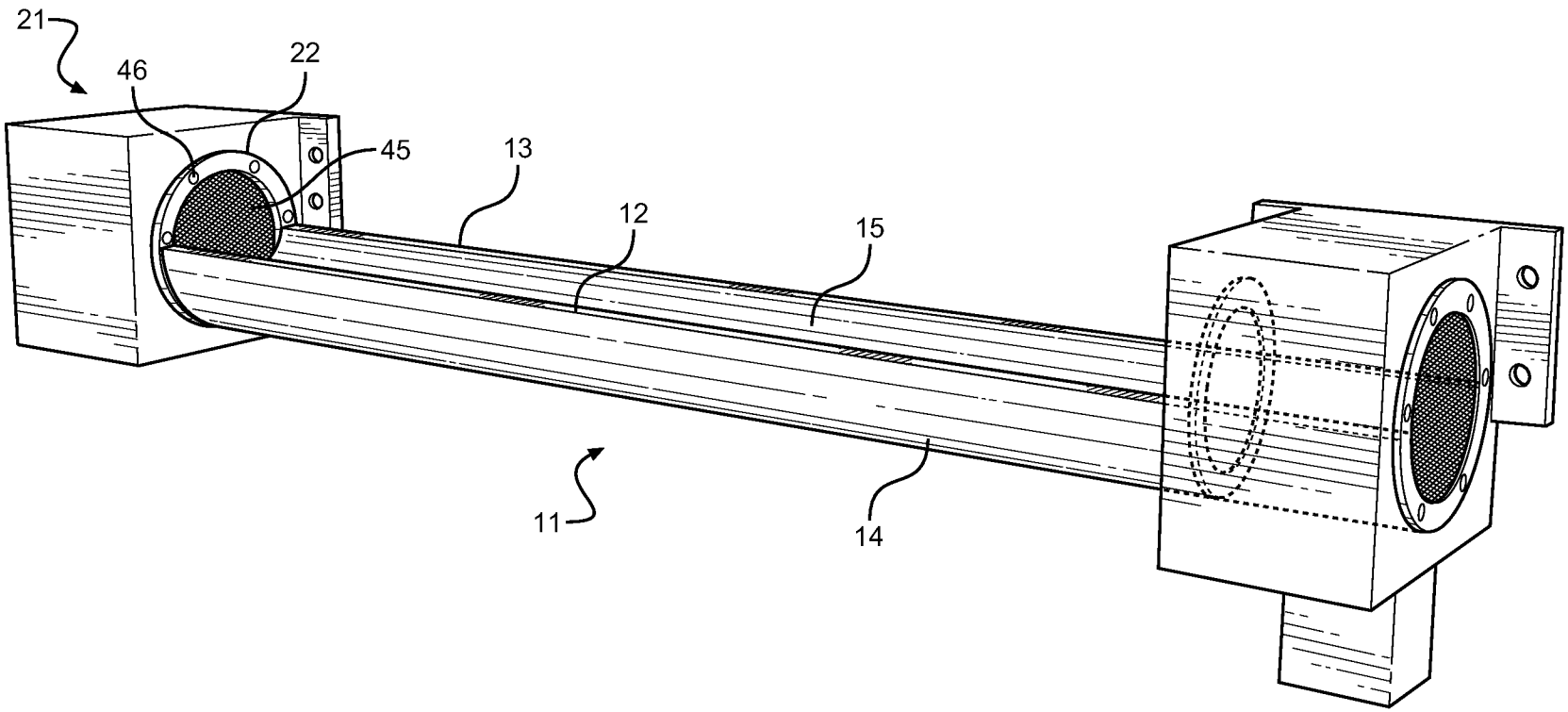
FIG. 1 shows a perspective view of the rain gutter attached between a pair of gearboxes.

Reference is made herein to the attached drawings. Like reference numerals are used throughout the drawings to depict like or similar elements of the rain gutter. For the purposes of presenting a brief and clear description of the present invention, the preferred embodiment will be discussed as used for attaching to a building for use as a conventional rain gutter. The figures are intended for representative purposes only and should not be considered to be limiting in any respect.

Referring now to FIG. 1, there is shown a perspective view of the rain gutter attached between a pair of gearboxes. The device comprises at least one section of a rain gutter 11 that is supported by a pair of gearboxes 21 on either side thereof. The gearboxes 21 are equipped with a rotating assembly 22, which enables the gutter 11 to rotate inline to a downward position away from a building. Each gearbox 21 includes a drive means for rotating the gutter 11, such as a set of meshing gears. The gearbox 21 additionally includes a mesh screen 45 that snaps into place, and a plurality of apertures 46 on each end that allow for attachment of the gutter 11. During a storm, rainwater may be collected by the gutters 11 and channeled therethrough to the downspout and away from the building. If debris is left behind in the gutter 11, a user may rotate the gutters 11 until they face the ground, where a hose or power sprayer may be used to clear the gutter 11 of any debris contained therein. Once cleaned, the user may return the gutter 11 to its original position.

The gutter 11 of the present invention includes a front wall 12, rear wall 13, a bottom wall 14, and an open top 15. The gutters 11, can be made from a variety of materials, including, zinc, galvanized steel, painted steel, copper, painted aluminum, polyvinyl chloride ("PVC"), or another similar material suited for long term outdoor use and for conveying water therethrough. In the preferred embodiment, the gutters 11 form a semicircle. This enables the gutters 11 to rotate within the gearbox 21 so that the gutters 11 can be pivoted from their normal working position to face the ground.

The gutters 11 are installed along the fascia of a roof, and operate in a conventional manner. When rain falls on the roof of a building, the rainwater moves towards the edges thereof; as the rainwater reaches the edge of the roof, it falls from the roof and into the rain gutter 11 where it is channeled into a downspout and away from the building. The gutters 11 are held in place by the gearboxes 21, which are spaced about at regular intervals, thereby acting as a bracket to join each section. This provides a sufficient amount of support thereto, and prevents the gutters 11 from being damaged from heavy loads, such as rain or snow.

Figure 2:
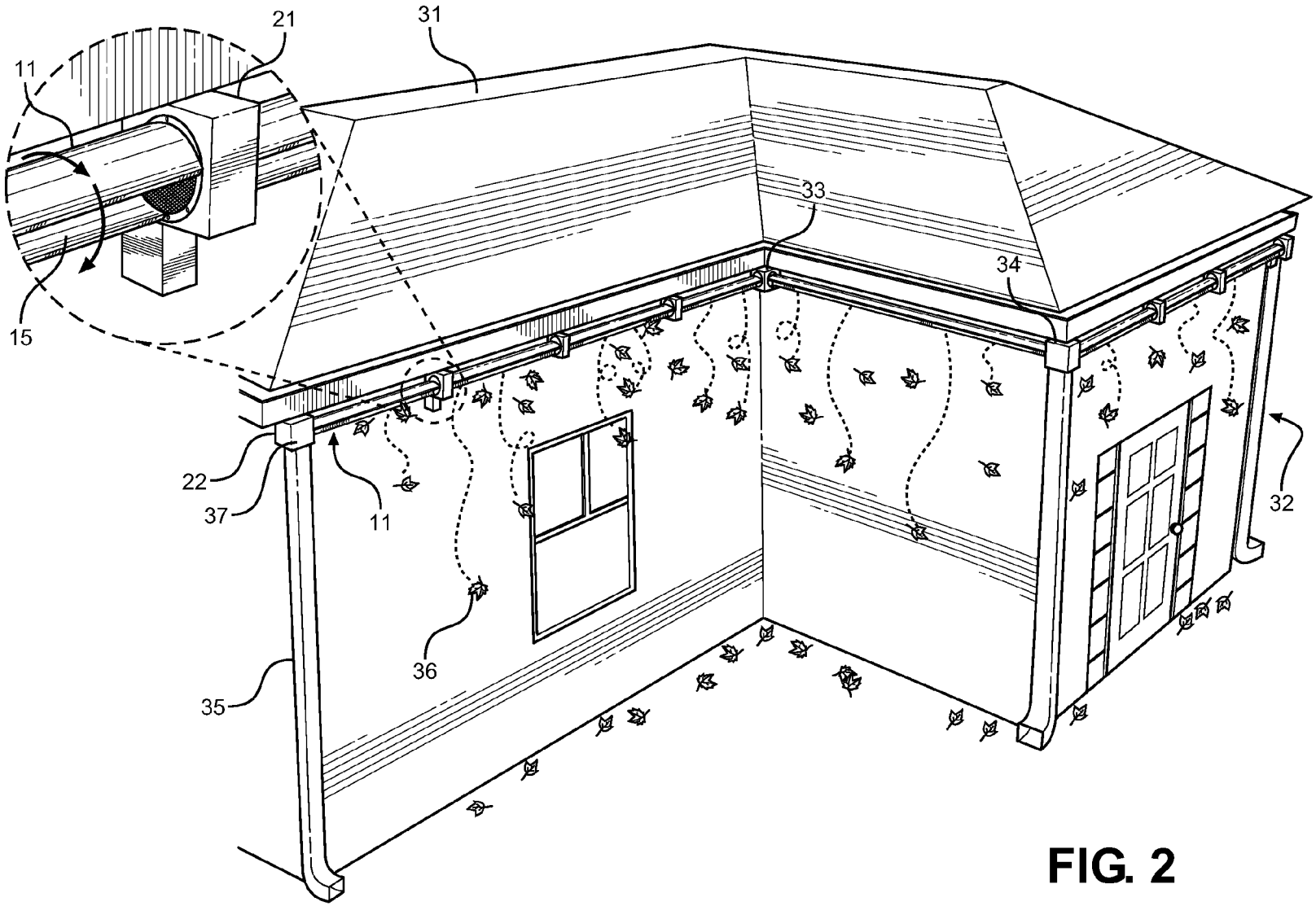
FIG. 2 shows a view of the present invention installed on a building, with a close-up view of the gutter rotating towards the ground.

Referring now to FIG. 2, there is shown a view of the present invention installed on a building, with a close-up view of the gutter 11 rotating towards the ground. The gutters 11 are installed below the edge of the roof 31 on a conventional building 32. This enables any rainwater contained therein to flow from the roof 31 and into the open top. The gearboxes 21 are installed at regular intervals along the length of the roof 31. The gutters 11 can be cut to fit in sections that cannot hold an entire length of gutter 11. In such locations, the gutter 11 can be removed from the gearbox 21, cut to a desired length, reattached to the gearbox 21, and installed in a desire location.

The gearboxes 21 can be designed to fit both inside corners 33, as well as outside corners 34. Normally, the gearbox 21 is designed to hold the gutter 11 in a straight line configuration, with the openings for attachment of the gutter 11 being on opposing sides. With an inside corner 33, the openings for the gutter 11 are positioned such that the gutters 11 can form a right inside angle. For an outside corner 34, the openings for the gearbox 21 form an outside right angle. This enables the gutters to be placed substantially around the entire length of a building 32. At the end of each section of gutters 11 can be an end cap 37 that terminates the gutter section, or alternatively a downspout 35 that is designed to channel the water from the gutters 11 and away from the foundation of the building 32. The downspout 35 is joined to the gutter 11 with a gearbox 21 that includes a vertical opening. This provides a connection from the gutter 11 to the downspout 35 for removing water therefrom.

The gutters 11 can be rotated downward so that the open top 15 faces away from the roof 31 and towards the ground. This permits debris, such as leaves 36 that are contained within the gutter 11 to fall to the ground. To clean the device, a user can rotate the gutters 11, which will allow all the loose debris contained therein to be removed therefrom. The user can then remove any remaining debris with the use of a hose or sprayer. A stream of high pressure water can be directed at the open top 15, which will remove debris that is stuck together and does not fall to the ground due to gravity. Similarly, the same process can be used during times of the year when snow builds up inside the gutters 11. A user can rotate the gutters 11, which will cause any snow or ice contained there to fall to the ground, thereby allowing the melted ice and snow from the roof to be channeled away from the building 32.

The gutters 11 are attached to the gear box 21 in such a way as to permit inline rotation. This prevents the need for a hinge that would cause the gutter to pivot in a circular arc. Gutters that pivot in such a manner are lifted up from a bracket, and pivot about a hinge, which causes the gutter to lift any weight contained therein. Such systems are generally lifted from a single location, meaning that the sections of the gutter that are further away from the lifting point can experience a significant amount of torque if the gutters contain ice or snow. This can cause the gutters to deform, thereby requiring repair or replacement. The present invention rotates the gutter 11 inline with the use of several gear boxes 21 that are space about at regular intervals. This prevents the gutter 11 from pivoting in a circular arc around a hinge, and also prevents the gutter 11 from lifting the weight contained therein when rotated. When activated, the gutter 11 simply rotates in place, thereby displacing the contents contained therein without requiring the gutter 11 to lift the weight up and over for removal.

Figure 3:
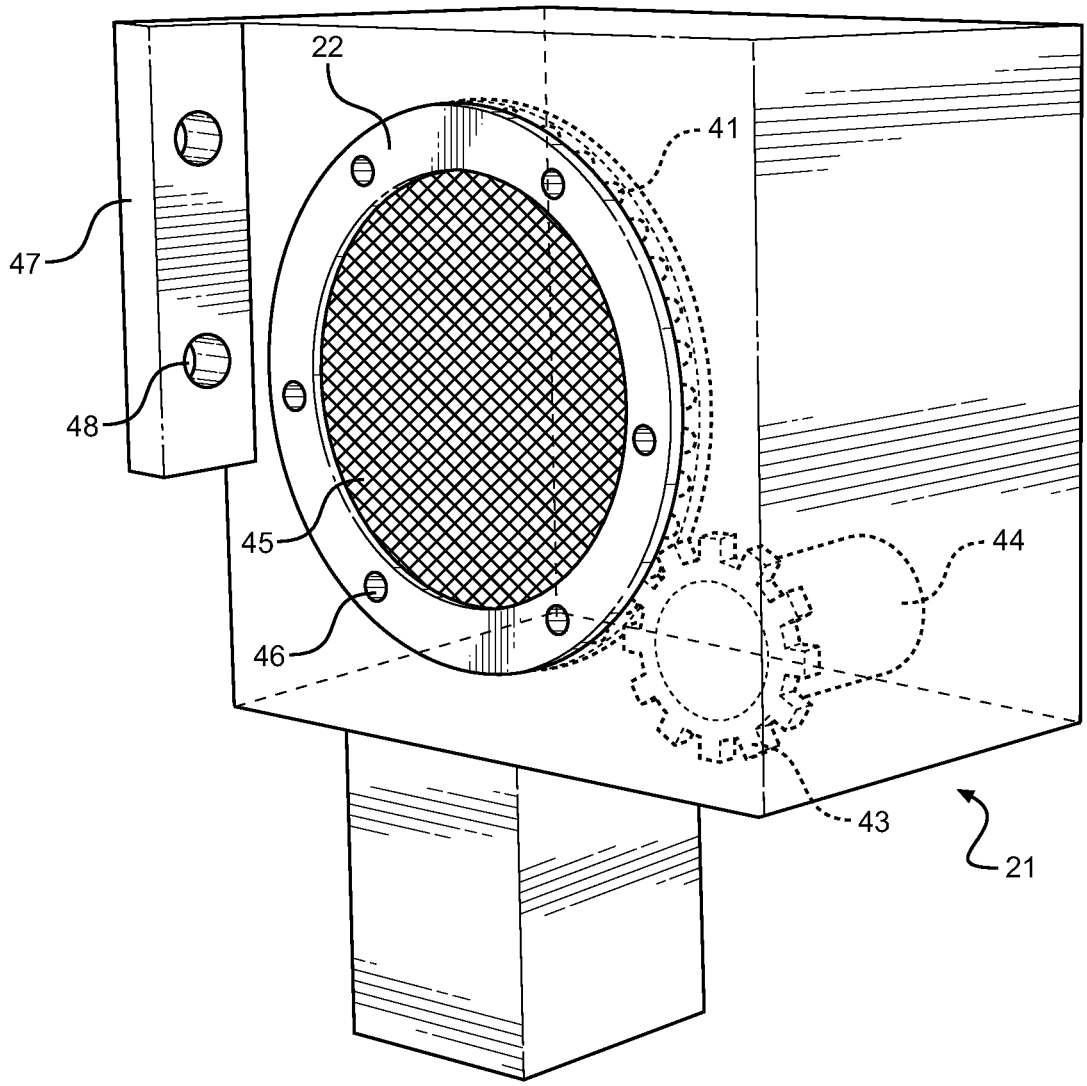
FIG. 3 shows a close-up view of the gearbox.

Referring now to FIG. 3, there is shown a close-up view of the gearbox 21. The gearbox 21 includes a means of rotating the gutter 11 inline. This is accomplished with a rolling-element bearing, such as a ball bearing 41, which is well understood in the art. The ball bearing 41 is attached to the rotating assembly 22, which reduces the rotational friction between the gear box 21 and the gutter 11, thereby enabling inline rotation thereof.

The gearbox 21 additionally includes a drive means for rotating the gutter 11. In the preferred embodiment, the drive means includes a gear mechanism that enables automatic rotation of the gutter, such as a set of meshing gears. A first gear 42 can be attached to the rotating assembly 22, with a second gear 43 being attached to an electrical motor 44. While shown and described as a series of mesh gears, the drive means may alternately comprise another mechanical form, such as a helical gear, worm gear, pulley wheel, or other mechanical structure that can cause inline rotation of the gutter.

The electrical motor 44 is preferably a fractional horsepower motor that is well understood in the art. The electrical motor 44 can run on alternating or direct current, and can be powered by a conventional electrical socket, or by a battery. When power is applied to the electrical motor 44, the second gear 43 rotates, which in turn causes the first gear 42 that is attached to the rotating assembly 22 to rotate, thereby causing the gutter to move from a rain catching position to a cleaning position. The electrical motor 44 is disposed within the gearbox 21, which protects the device from being exposed to water. The electrical motor 44 is preferably operated by a remote control, which enables a user to activate the system from ground level. Alternatively, the system can be operated by a switch on the gearbox 21.

The rotating assembly 22 further includes a mesh screen 45 that attaches thereto. The mesh screen 45 prevents debris from entering into the gearbox 21, which could otherwise interfere with the drive means. The mesh screen 45 allows water to pass through the gear box 21 as it travels through the gutters 11 and to the downspout. As best shown in FIG. 1, the gutter 11 extends through the gearbox 21, thereby creating a continuous series of gutters 11 for channeling water away from a building. The mesh screen 45 includes an attachment means for attachment to the rotating assembly 22. In the preferred embodiment, the screen 45 snaps into position on the rotating assembly 22, which allows a user to easily remove the screen 45 in order to access the inside of the gearbox 21. The rotating assembly 22 further includes a plurality of apertures 46 spaced thereabout that provide an attachment point for the gutter 11. The gutter 11 includes a series of extensions that aligns with the apertures 46, allowing the gutter to be secured into position.

The gearbox 22 additionally includes an attachment means that enables the system to be secured to the fascia of a building. Preferably, the attachment means comprises a bracket 47 that contains a plurality of apertures 48. The apertures 48 are designed to accept a fastening means. The gearbox 21 can be positioned on the fascia of a building, and fastened into place. The gearboxes 21 can be positioned at regular intervals, such as in four foot intervals, which provide sufficient support to the system.

Overall, the device provides a simple and effective means of cleaning a rain gutter. The rotating assembly enables the device to be rotated inline to a downward position away from a building. A user can activate the system from the ground, which is particularly beneficial to users who have difficulty with climbing a ladder. Once installed, the device requires little to no maintenance, and allows a user to rotate the gutters for cleaning. This prevents debris from building up within the gutters, and allows the user to quickly remove ice and snow therefrom, without applying torque to the system that may deform the gutter.

To this point, the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rain gutter system that permits a rain gutter to be inverted, comprising:

a plurality of semicircular rain gutter sections each of said rain gutter sections having a front wall, a back wall, a bottom wall, a first end, a second end, and an open top, a plurality of rotating assemblies, each of said rotating assemblies comprising a housing having a first aperture disposed on a first side of said housing, and a second aperture disposed on a second, laterally opposing side of said housing and a fluid conduit internally connecting said first and second apertures and adapted to permit fluid to flow through said housing;

each of said first and second apertures having an outer covering comprising a covering frame and a mesh screen secured to the covering frame, wherein a plurality of connection points are disposed along an outer surface of each of said covering frames, and wherein said connection points removably secure said outer surface to one of said first and second ends of one of said rain clutter sections;

each of said rotating assemblies having a drive means for rotating said rain gutter sections along an elongated axis away from a building and positioning said open top into a downward-facing position.

2. The rain gutter system of claim 1, wherein said rotating assembly further comprises an attachment means enabling said rotating assembly to attach to a fascia of a building.

3. The rain gutter system of claim 1, wherein said housing further comprises a rolling-element bearing, said rolling-element bearing reducing rotational friction between said rotating assembly and said gutter.

4. The rain gutter system of claim 1, wherein said drive means comprises a gear mechanism enabling driven rotation of said gutter.

5. The rain gutter system of claim 4, wherein said drive means further comprises a set of meshing gears and an electrical motor.

6. The rain gutter system of claim 1, wherein said rotating assembly further comprises a remote control for enabling remote activation of said gutter rotation.

7. The rain gutter system of claim 1, wherein at least one of said rotating assemblies further comprises a lower downspout connection means and a pathway for fluid to flow from said gutter through said rotating assembly and into said downspout.

* * * * *